US010539003B2

(12) United States Patent
Gao et al.

(10) Patent No.: US 10,539,003 B2
(45) Date of Patent: Jan. 21, 2020

(54) METHODS AND NETWORKS TO DETERMINE A BOUNDARY OF A CEMENT MIXTURE

(71) Applicant: Halliburton Energy Services, Inc., Houston, TX (US)

(72) Inventors: Li Gao, Katy, TX (US); Daniel Joshua Stark, Houston, TX (US); Krishna Ravi, Kingwood, TX (US); Christopher Lee Stokely, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 32 days.

(21) Appl. No.: 16/330,342

(22) PCT Filed: Dec. 7, 2016

(86) PCT No.: PCT/US2016/065409

§ 371 (c)(1),
(2) Date: Mar. 4, 2019

(87) PCT Pub. No.: WO2018/106230

PCT Pub. Date: Jun. 14, 2018

(65) Prior Publication Data

US 2019/0226320 A1 Jul. 25, 2019

(51) Int. Cl.
*E21B 47/00* (2012.01)
*E21B 47/14* (2006.01)
(Continued)

(52) U.S. Cl.
CPC ..... *E21B 47/0005* (2013.01); *E21B 47/101* (2013.01); *E21B 47/14* (2013.01); *E21B 33/14* (2013.01)

(58) Field of Classification Search
None
See application file for complete search history.

(56) References Cited

U.S. PATENT DOCUMENTS 3,747,702 A 7/1973 Beil
4,255,798 A 3/1981 Havira
(Continued)

FOREIGN PATENT DOCUMENTS

WO 2016-153465 A1 9/2016

OTHER PUBLICATIONS

International Search Report & Written Opinion issued for corresponding International Application No. PCT/US2016/065409 dated Aug. 28, 2017. (13 pages).
(Continued)

*Primary Examiner* — Muhammad N Edun
*Assistant Examiner* — Jerold B Murphy
(74) *Attorney, Agent, or Firm* — McGuireWoods LLP

(57) ABSTRACT

The disclosed embodiments include methods and networks to determine a boundary of a cement mixture. In one embodiment, the method includes detecting first acoustic signals transmitted from at least one of a first plurality of acoustic tags that are mixed with cement slurry, where the cement slurry is deposited in a first section of a wellbore in an annulus between a casing and the first section of the wellbore. The method also includes determining a location of a first boundary of the cement slurry based on the first acoustic signals.

17 Claims, 4 Drawing Sheets

(51) Int. Cl.
*E21B 47/10* (2012.01)
*E21B 33/14* (2006.01)

(56) References Cited

U.S. PATENT DOCUMENTS

| | | | | |
|---|---|---|---|---|
| 5,124,953 | A | 6/1992 | Grosso | |
| 7,068,183 | B2 | 6/2006 | Shah et al. | |
| 8,634,273 | B2 | 1/2014 | Gardner et al. | |
| 8,813,838 | B2 | 8/2014 | Cavender et al. | |
| 2011/0192594 | A1* | 8/2011 | Roddy | E21B 33/13 166/250.01 |
| 2012/0155508 | A1 | 6/2012 | Dria et al. | |
| 2012/0205103 | A1 | 8/2012 | Ravi et al. | |
| 2014/0121979 | A1 | 5/2014 | Grimsbo et al. | |
| 2014/0174732 | A1 | 6/2014 | Goodwin et al. | |
| 2014/0180592 | A1* | 6/2014 | Ravi | E21B 47/101 702/12 |
| 2014/0262594 | A1 | 9/2014 | Lee | |
| 2015/0177198 | A1 | 6/2015 | Thierry et al. | |
| 2016/0266086 | A1* | 9/2016 | Von Herzen | G01N 33/383 |

OTHER PUBLICATIONS

Benoit Froelich, "Multimode Evaluation of Cement Behind Steel Pipe" The Journal of the Acoustical Society of America 123, 3648 (2008), 6 pages.

* cited by examiner

METHODS AND NETWORKS TO DETERMINE A BOUNDARY OF A CEMENT MIXTURE

BACKGROUND

The present disclosure relates generally to methods to determine a boundary of a cement mixture deployed in a wellbore as well as downhole acoustic communication networks operable to determine the boundary of the cement mixture.

A wellbore is often drilled proximate to a subterranean deposit of hydrocarbon resources to facilitate exploration and production of hydrocarbon resources. Sections of casings are often coupled together and deployed in the wellbore to insulate downhole tools and strings deployed in the casing as well as hydrocarbon resources flowing through casing from the surrounding formation, to prevent cave-ins, and/or to prevent contamination of the surrounding formation.

A cement job is usually performed to fixedly secure the casing to the wellbore. In some embodiments, a cement plug (bottom plug) having a diaphragm that ruptures or breaks when a threshold pressure is applied to the diaphragm is deployed in the casing. A predetermined volume of cement slurry is then pumped into the casing. The predetermined volume is often calculated based on a desired volume of an annulus between the casing and the wellbore that the cement slurry should fill to fixedly secure the casing to the wellbore. The pressure from the cement slurry exceeds the threshold pressure, thereby causing the diaphragm to break and allowing the cement to flow past the bottom plug. A top plug is then inserted into casing and a displacement fluid is pumped into the casing. Pressure from the displacement fluid forces the cement slurry until the desired volume of the annulus is filled with the cement slurry. The displacement fluid may then be pumped out through the casing or through another annulus and the cement plugs may be drilled out, or dissolved.

Although the foregoing cementing process is often practiced in the oil and gas industry, existence of one or more leaks in the formation surrounding the wellbore may cause the predetermined volume of cement slurry needed to complete a cement job to deviate from the actual volume of cement slurry needed to complete the cement job. Further, imprecision and calculation errors related to determining the volume of annulus that the cement slurry should fill may further cause the predetermined volume to deviate from the actual volume.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
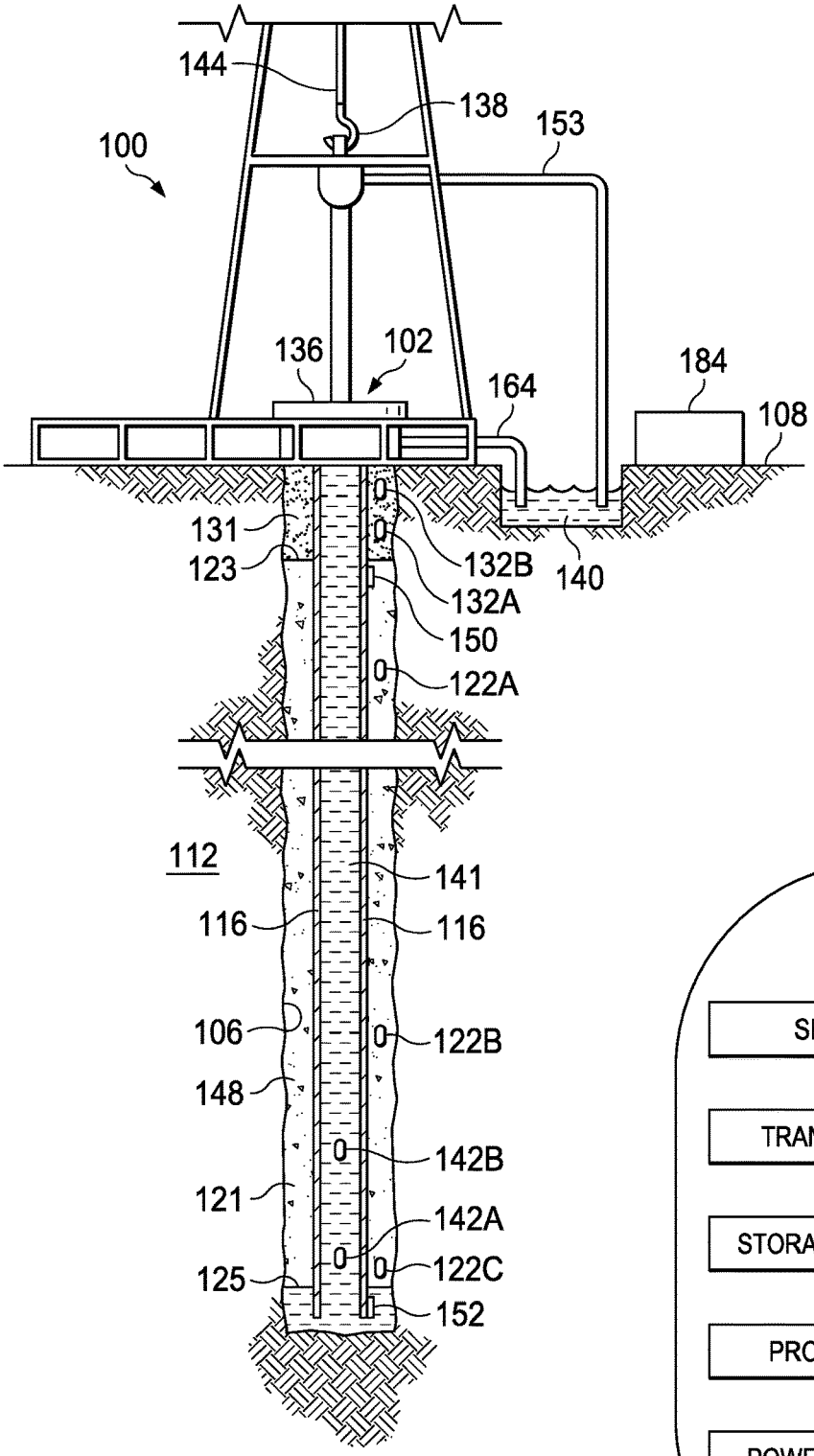
FIG. 1A illustrates a schematic view of a well environment in which a cement mixture containing cement and a first plurality of acoustic tags is deposited in an annulus between a casing and subterranean formation.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods to determine a boundary of a cement mixture deployed in a wellbore as well as downhole acoustic communication networks operable to determine the boundary of the cement mixture. A cement mixture containing cement slurry and a first plurality of acoustic tags is pumped into a casing deployed in a wellbore. As defined herein, a cement mixture is a mixture of cement, cement slurry, and/or any chemical additives, such as retarders, with one or more acoustic tags. A predetermined volume of the cement mixture is poured into the casing to fill a section of an annulus between the casing and the wellbore, thereby fixedly securing the casing to the wellbore. A force is then applied directly and/or indirectly to the cement mixture to displace the cement mixture from the casing into the annulus. In some embodiments, a displacement fluid is pumped down the casing to displace the cement mixture into the annulus. Once the cement mixture is displaced into the annulus, boundaries of the cement are at least defined by the top of cement (first boundary), outer diameter of the casing, and the wellbore.

Each acoustic tag of the first plurality of acoustic tags is operable to transmit acoustic signals within a first frequency range. In some embodiments, one or more sensor boxes operable to detect the transmitted acoustic signals are deployed along the casing. In other embodiments, an optical fiber deployed along the casing is operable to perform distributed acoustic sensing of the transmitted acoustic signals. In further embodiments, a downhole tool deployed inside the casing is operable to detect the transmitted acoustic signals. In some embodiments, each acoustic tag of the first plurality of acoustic tags is also operable to transmit acoustic signals indicative of an identification of the respective acoustic tag.

The acoustic signals transmitted from the first plurality of acoustic tags are utilized to determine a location of the first boundary. In some embodiments, the annulus also contains a mixture of mud and a second plurality of acoustic tags. As the cement mixture is displaced into the annulus, the cement mixture applies a force to the mud mixture, thereby displacing the mud mixture. In one of such embodiments, the first boundary also defines the boundary between the mud mixture and the cement mixture. In such an embodiment, the acoustic signals transmitted from the second plurality of acoustic tags are also utilized to determine the location of the first boundary. In further embodiments, a fluid mixture containing displacement fluids and a third plurality of acoustic tags is pumped down the casing to displace the cement mixture into the casing. In one of such embodiments, a bottom of the cement mixture (second boundary) is defined by the boundary between the cement mixture and the fluid mixture. In such an embodiment, acoustic signals transmitted from the first and/or third plurality of acoustic tags may be utilized to determine the location of the second boundary. In some embodiments, acoustic signals transmitted from the first plurality of acoustic tags are also utilized to determine presence of one or more leaks in the formation. Additional descriptions of determining the boundaries of the cement mixture based on acoustic signals as well as other applications of the acoustic signals are provided in the paragraphs below and are illustrated in at least FIGS. 1-4.

Now turning to the figures, FIG. 1A illustrates a schematic view of a well environment 100 in which a cement mixture 121 containing cement and a first plurality of acoustic tags 122A-C is deposited in an annulus 148 between a casing 116 and subterranean formation 112. In the embodiment of FIG. 1A, a well 102 having a wellbore 106 extends from a surface 108 of the well 102 to or through the subterranean formation 112. The casing 116 is deployed along the wellbore 106 to insulate downhole tools and devices deployed in the casing 116, to provide a path for hydrocarbon resources flowing from the subterranean formation 112, to prevent cave-ins, and/or to prevent contamination of the subterranean formation 112. The casing 116 is normally surrounded by a cement sheath formed from cement slush, such as the cement mixture 121, and deposited in an annulus between the casing 116 and the wellbore 106 to fixedly secure the casing 116 to the wellbore 106 and to form a barrier that isolates the casing 116. Although not depicted, there may be layers of casing concentrically placed in the wellbore 106, each having a layer of cement or the like deposited thereabout.

At wellhead 136, an inlet conduit 153 is coupled to a fluid source (not shown) to provide fluidly mixtures, such as the cement mixture 121 or mixtures of other fluids that are mixed with acoustic tags, downhole. The casing 116 has an internal cavity that provides a fluid flow path from the surface 108 downhole. A downward pressure exerted on the cement mixture 121 displaces the cement mixture 121 into an annulus 148 between the casing 116 and the surrounding formation 112. More particularly, a fluid mixture 141 containing a displacement fluid and a third plurality of acoustic tags 142A and 142B is pumped into the casing 116 to displace the cement mixture 121 into the annulus 148. A second boundary 125 of the cement mixture 121 defining the bottom of the cement mixture is formed when the cement mixture 121 comes into contact with the fluid mixture 141.

A mud mixture 131 containing a mixture of mud and a second plurality of acoustic tags 132A and 132B is present in the annulus 148 at the time the cement mixture 121 is displaced into the annulus 148. In one of such embodiments, a first boundary 123 of the cement mixture 121 defining the top of the cement mixture is formed when the cement mixture 121 comes into contact with the mud mixture 131.

As the cement mixture 121 is displaced into the annulus 148, the cement mixture 121 applies a force to the mud mixture 131, thereby displacing some of the mud mixture 131 from the annulus 148 to an outlet conduit 164, and eventually into a container 140. A pump (not shown) may also facilitate displacing the cement mixture 121 and extracting the mud mixture 131 from the annulus 148 into the container 140.

First and second sensor boxes 150 and 152 are deployed along the casing 116 proximate the first and second boundaries 123 and 125 of the cement mixture 121, respectively. The first and second sensor boxes 150 and 152 are operable to detect acoustic signals transmitted from one or more of the first, second, and third plurality of acoustic tags 122A-C, 132A, 132B, 142A, and 142B. Each of the first and second sensor boxes 150 and 152 contains a storage medium operable to store acoustic signals transmitted form one or more acoustic tags deployed in the wellbore 106.

In some embodiments, each of the first and second sensor boxes 150 and 152 includes components operable to determine the boundaries of the cement mixture 121. In one of such embodiments, characteristics of acoustic signals, such as the frequency, amplitude, timing, delay, phase shift, as well as other characteristics disclosed herein, are transmitted from the first acoustic tag 122A of the first plurality of acoustic tags 122A-C are examined to determine a location of the first boundary 123 of the cement mixture 121. For example, if the first acoustic tag 122A is deployed a first distance from the first sensor box 150, then the characteristics of the acoustic signals may be evaluated to determine whether the acoustic signals traveled through the cement mixture 121, the mud mixture 131, and/or the formation 112 to reach the first sensor box 150. The characteristics of the acoustic signals may also be evaluated to determine the approximate distance the acoustic signals traveled in each type of formation. The foregoing information is then used to determine the location of the first boundary 123 of the cement mixture 121. Similarly, characteristics of the first acoustic tag 132A of the second plurality of acoustic tags 132A and 132B are also evaluated in a similar manner to determine the location of the first boundary 123 of the cement mixture 121. In another one of such embodiments, characteristics of acoustic signal generated by the first acoustic tags 122A and 132A are both analyzed to triangulate the location of the first boundary 123 of the cement mixture 121.

In another one of such embodiments, the intensity of acoustic signals transmitted from the first acoustic tag 122A of the first plurality of acoustic tags 122A-C and the first acoustic tag 132A of the second plurality of acoustic tags 132A and 132B are examined to determine the location of the first boundary 123 of the cement mixture 121. For example, if the first acoustic tag 122A is deployed proximate the top of the cement, then the first boundary 123 of the cement mixture 121 is at or proximate a location where the signal intensity of acoustic signals transmitted by the first acoustic tag 122A is greater than a first threshold. Similarly, if the first acoustic tag 132B is also deployed proximate to the top of the cement, then the first boundary 123 of the cement mixture 121 is at or proximate a location where the signal intensity of acoustic signals transmitted by both the first acoustic tags 122A and 132A are greater than the first threshold. In a further embodiment, where the first acoustic tag 122A transmits acoustic signals within a first frequency range and where the first acoustic tag 132A transmits acoustic signals within a second frequency range, the location of the first boundary is determined to be a location where acoustic signals within both the first and second frequency ranges are detected. In a further embodiment, the acoustic signals contain indications of the location of the first boundary 123 of the cement mixture 121. In such an embodiment, the location of the first boundary 123 of the cement mixture 121 is based on the indication of the location of the first boundary 123 of the cement mixture 121. In a further embodiment, the relative attenuations of the acoustic signals traveling through different mediums are determined and utilized to determine the location of the first boundary 123 of the cement mixture 121. For example, the acoustic signals are transmitted at different frequencies and the relative attenuation of the acoustic signals at different frequencies are determined. For example, the relative attenuations of acoustic signals traveling through the cement mixture 121 and the mud mixture 131 may be determined based on the foregoing process. The signal intensities of acoustic signals transmitted from the first acoustic tags 122A and 132A are then calculated. The location of the first boundary 123 of the cement mixture 121 is then calculated based on the different signal intensities of the acoustic signals due to the relative attenuations of the acoustic signals traveling through the mediums.

The second sensor box 152 is operable to utilize the foregoing methods as well as other methods disclosed herein to determine the location of the second boundary 125 of the cement mixture 121. For example, second sensor box 152 is operable to detect acoustic signals transmitted from the third acoustic tag 122C of the first plurality of acoustic tags 122A-C and the first acoustic tag 142A of the third plurality of acoustic tags 142A and 142B to determine the location of the location of the second boundary 125 of the cement mixture 121.

The determined location of the first boundary 123 of the cement mixture 121 may be used to determine whether sufficient cement mixture has been pumped into the annulus. In one embodiment, a predetermined volume of cement mixture 121 is pumped into the casing 116. An estimated location of the top of the cement may be calculated based an estimated volume of the annulus 148 and the predetermined volume of the cement mixture. The location of the first boundary 123 of the cement mixture 121 determined based on acoustic signals is compared with the estimated location of the top of the cement. If the disparity between the determined location and the estimated location is greater than a threshold, then a leak is present in the formation 112. The presence of leaks in the formation may also be determined based on acoustic signals transmitted from one of the acoustic tags deployed in the wellbore 106. As stated herein, the characteristics and intensity of acoustic signals transmitted from the acoustic tags may be evaluated to determine the types of formations that the acoustic signals traversed through as well as the distance from the transmitting acoustic tag to a nearby sensor box. For example, if acoustic signals transmitted from the first acoustic tag 122A travel a distance significantly greater than the width of the annulus 148 before the acoustic signals reach the first sensor box 150, then the first acoustic tag 122A may be deposited in a leak in the formation 112.

In some embodiments, a set of acoustic signals transmitted from one of the sensors may be received by one of the first and second sensor boxes 150 and 152 on multiple occasions. For example, a first set of acoustic signals transmitted from the first acoustic tag 122A may be received by the first sensor box 150 at $\tau_1$, is partially reflected by a first surface of the wellbore 106 at $\tau_2$, is partially reflected by the first boundary 123 at $\tau_3$, and is received by the first sensor 150 $\tau_4$. In one of such embodiments, the first sensor box 150 is operable to determine an approximate velocity of the first set of acoustic signals or a frequency range of the first acoustic signals. The first sensor box 150 is further operable to determine the location of the first boundary 123 relative to the first sensor box 150 based on the timing difference between $\tau_1$ and $\tau_4$, and based on the approximate velocity and/or the frequency range of the first set of acoustic signals. In another one of such embodiments, the first set of signals received at $\tau_1$ has a first amplitude and a first signal strength of noise ratio (SNR). The same set of signals received at $\tau_4$ has a second amplitude and a second SNR. In such embodiment, the first sensor box 150 is operable to determine the location of the first boundary 123 based on the signal decay (loss of amplitude, SNR decay) of the first set of acoustic signals.

A hook 138, cable 144, traveling block (not shown), and hoist (not shown) are provided to lower a conveyance (not shown) down the wellbore 106 or to lift the conveyance up from the wellbore 106. The conveyance may be a wirelines slickline, coiled tubing, drill pipe, production tubing, downhole tractor, or another type of conveyance that has an internal cavity to provide fluid flow for the mud mixture 121 and/or the fluid mixture 141 downhole. In some embodiments, a downhole tool (not shown) is coupled to the conveyance and is communicatively connected to the sensor boxes 150 and 152. The downhole tool is operable to retrieve acoustic signals stored in the sensor boxes 150 and 152 as well as data indicative of the first and second boundaries 123 and 125 of the cement mixture 121. In other embodiments, the downhole tool is operable to detect acoustic signals transmitted from one or more of the first, second, and third plurality of acoustic tags 122A-C, 132A, 132B, 142A, and 142B.

The acoustic signals are provided to a controller 184 that is accessible by an operator. The controller 184 includes at least one electronic device that is operable to receive acoustic signals and is operable to process the acoustic signals to determine the location of the first and second boundaries 123 and 125 of the cement mixture 121. In some embodiments, the controller 184 is also operable to determine properties of the cement mixture 121, the mud mixture 131 and/or the fluid mixture 141. Although controller 184 is illustrated in FIG. 1A as a surface based device, the controller 184 may also be deployed as a downhole device, or may be a component of the downhole tool or one of the sensor boxes 150 and 152. Although FIG. 1A illustrates a certain number of acoustic tags and sensor boxes deployed in the wellbore 106, the cement mixture 121, mud mixture 131, and fluid mixture 141 may each contain a different number of acoustic tags. Similarly, a different number of sensor boxes may be deployed along the casing 116.

Figure 1B:
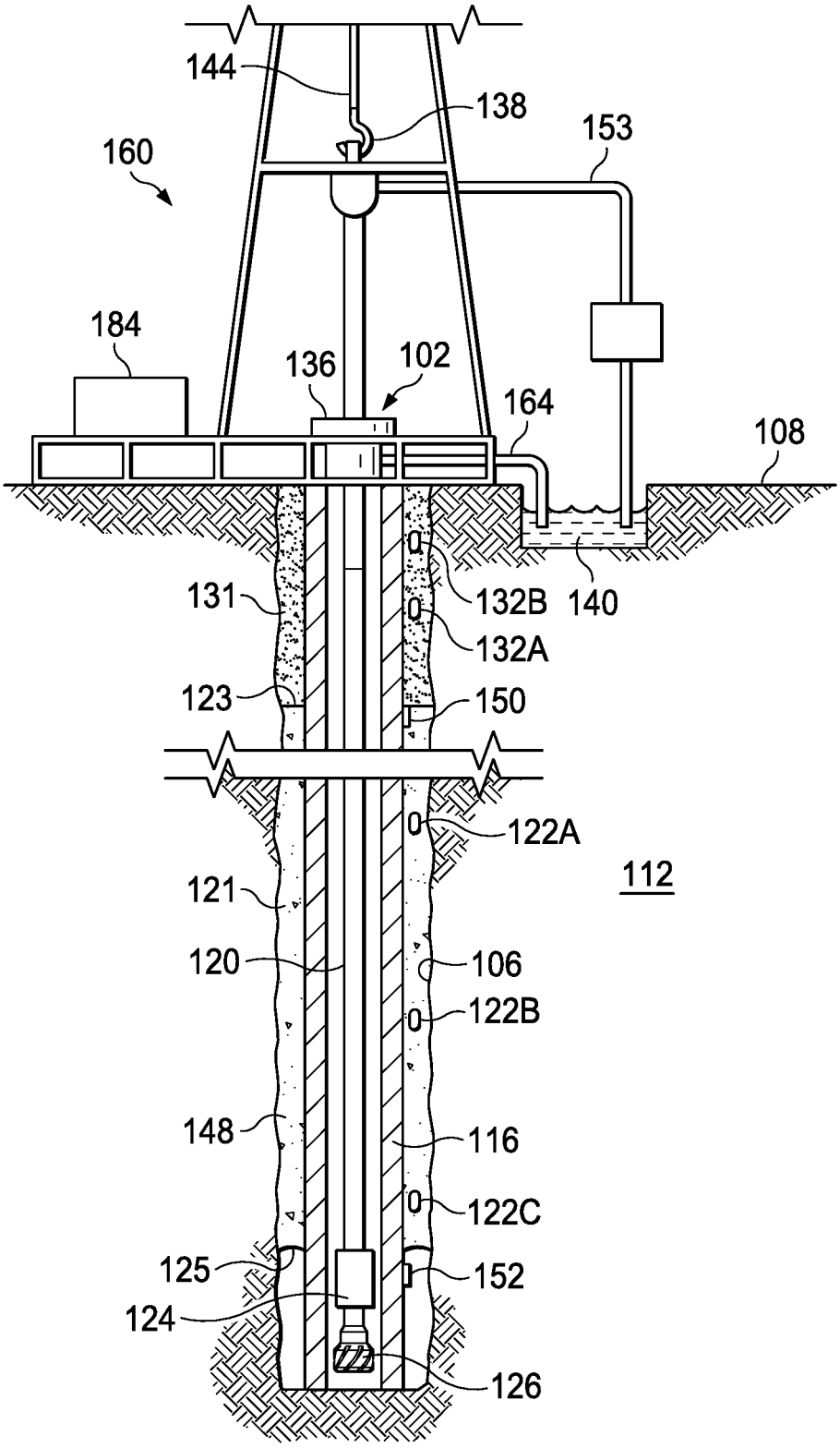
FIG. 1B illustrates a drilling environment in which the cement mixture containing cement and the first plurality of acoustic tags is deposited in an annulus between the casing and subterranean formation.

Acoustic tags and sensor boxes, such as the first and second plurality of acoustic tags 122A-122C and 132A-132B, and the first and second sensor boxes 150 and 152, may be deployed in a variety of hydrocarbon production environments to determine the boundary of one or more cement mixtures deposited in the wellbore 106. FIG. 1B illustrates a drilling environment 160 in which the cement mixture 121 containing cement and the first plurality of acoustic tags 122A-122C is deposited in an annulus between the casing 116 and subterranean formation 112. In this embodiment, the cement mixture 121 has been deposited along the first section of the wellbore 106, where the first and second boundaries 123 and 125 define two boundaries of the first section of the wellbore 106. Drill bit 126 is coupled to conveyance and is lowered down the wellbore 106 via the conveyance 120 to perform drilling operations on a second section (not shown) of the wellbore 106, which extends beyond the first section of the wellbore 106. For example, the first section of the wellbore 106 may be a main borehole of the wellbore 106, and the second section of the wellbore 106 may be a lateral borehole having one end adjacent to the first section of the wellbore 106. A cement job may be performed on the second section to deposit cement mixtures containing additional acoustic tags along the second section of the wellbore 106. The additional acoustic tags are operable to perform operations described herein to determine the boundaries of the cement mixture deposited along the second section of the wellbore 106. Further, additional sensor boxes (not shown) may also be deployed proximate the boundaries of the second section of the wellbore 106 to determine the boundaries of the cement mixture deposited along the second section of the wellbore 106.

In the embodiment of FIG. 1B, a downhole detector 124 operable to receive acoustic, electrical, or optical data emitted by the first and second sensor boxes 150 and 152 is coupled to the conveyance 120. During drilling operations, the downhole detector 124 communicates with the first and second sensor boxes 150 and 152 when the downhole detector 124 is deployed at a location proximate to the first and second sensor boxes 150 and 152, respectively. Data emitted by the first and second sensors 150 and 152 are stored on a storage component of the downhole detector 124 and may be manually retrieved by an operator and/or automatically retrieved by the controller 184 at the surface 108. In some embodiments, the downhole detector 124 is also operable to receive acoustic signals transmitted by the first and the second plurality of acoustic tags 122A-122C, 132A, and 132B to obtain data emitted by one or more of the acoustic tags 122A-122C, 132A, and 132B.

Figure 1C:
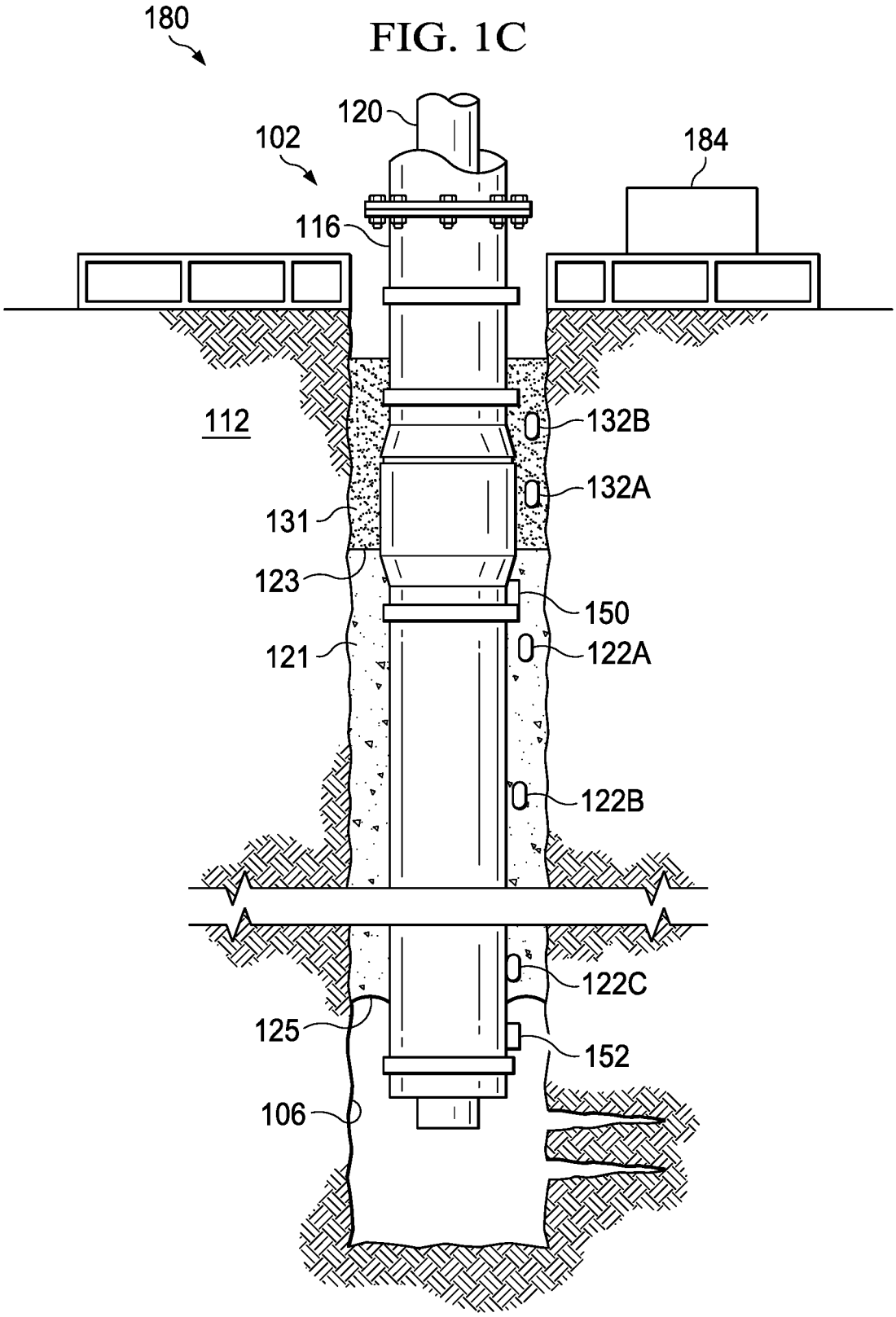
FIG. 1C illustrates a production environment in which the in which the cement mixture containing cement and the first plurality of acoustic tags is deposited in an annulus between the casing and subterranean formation.

Once the well 102 has been prepared and completed, the first and second plurality of acoustic tags 122A-122C, 132A, and 132B, and the first and second sensors 150 and 152 may be utilized to determine the boundary of the cement mixture. FIG. 1C illustrates a production environment 180 in which the in which the cement mixture 121 containing cement and the first plurality of acoustic tags 122A-122C is deposited in an annulus between the casing 116 and subterranean formation 112. In the embodiment of FIG. 1C, the first plurality of acoustic tags 122A-122C, the first sensor 150, and/or the second sensor 152 are operable to continuously monitor the first and second boundaries 123 and 125, and operable to provide the data indicative of boundaries locations of the first and second boundaries 123 and 125 to the logging tool 124, the controller 184, another logging tool, or another surface based electronic device.

Figure 2:
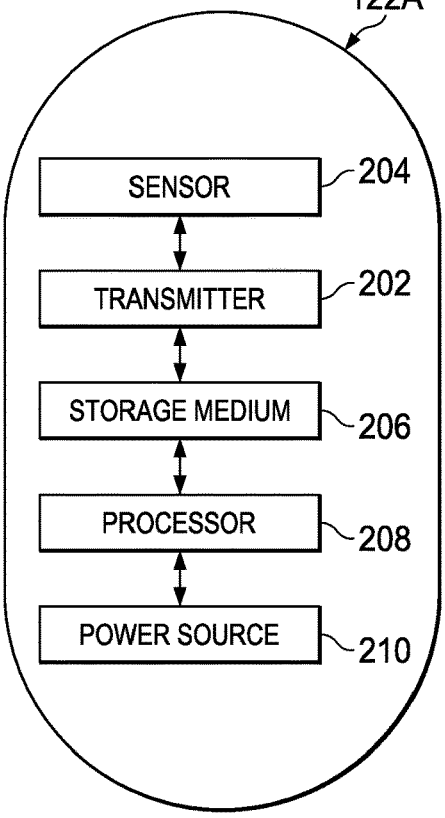
FIG. 2 illustrates a schematic view of a first acoustic tag of the first plurality of acoustic tags deployed in the well environment of FIG. 1A.

FIG. 2 illustrates a schematic view of the first acoustic tag 122A of the first plurality of acoustic tags 122A-C deployed in the well environment 100 of FIG. 1A. The first acoustic tag 122A includes a transmitter 202 that is operable to transmit acoustic signals at a first frequency range to the controller 184, or to a downhole tool, a sensor box, or another acoustic tag deployed proximate to the first acoustic tag 122A. In some embodiments, the acoustic signals include an indication of an identification of the first acoustic tag 122A. In other embodiments, the acoustic signals include an indication of a relative location of the first acoustic tag 122A. The relative location of the first acoustic tag 122A may include a distance from the first acoustic tag 122A to the first boundary 123 of the cement mixture 121, the second boundary 125 of the cement mixture 121, another boundary of a mixture the first acoustic tag 122A is deposited in, the formation, the surface 108, another acoustic tag, or another component or tool deployed in the wellbore 106. In further embodiments, the acoustic signals include instructions and signals used to establish communication channels and communication paths to communicatively connect the first acoustic tag 122A to another acoustic tag that is deployed within proximity of the first acoustic tag 122A, to another downhole sensor or tool, or to the controller 184. Additional descriptions of communication channels and communication paths are provided in the paragraphs below and are illustrated in at least FIGS. 3 and 4.

In some embodiments the transmitter 202 is a component of a transceiver (not shown) that is also operable to receive acoustic signals or other types of signals from the other acoustic tags 122B and 122C of the first plurality of acoustic tags 122A-C. In further embodiments, the first acoustic tag 122A includes a separate receiver component that is operable to receive acoustic signals, or other types of signals from the other acoustic tags 122B and 122C of the first plurality of acoustic tags 122A-C.

In some embodiments, the first acoustic tag 122A includes at least one sensor 204 that is operable to determine a position of the first acoustic tag 122A. For example, the at least one sensor 204 may include a sensor operable to determine a relative distance from the said sensor 204 to the first boundary 123 of the cement mixture 121, the relative distance from said sensor 204 to a nearby sensor box such as the first sensor box 150, as well as other position related measurements. In further embodiments, the at least one sensor 204 is also operable to determine nearby wellbore and/or hydrocarbon resource properties. Examples of wellbore properties include temperature, pressure, acoustic impedance, salinity, vibration, acoustic reflectance, resistivity, electrical impedance, electric potential, optical spectra, water cut, pH, and noise threshold as well as similar properties proximate the respective acoustic tag. Examples of hydrocarbon properties include a proximate location of hydrocarbon resources relative to the acoustic tag, material and chemical properties of the hydrocarbon resources, an approximate rate of production of the hydrocarbon resources, as well as similar properties. For example, the at least one sensor 204 may include a thermometer that senses a temperature of the wellbore 106 at a location proximate to the first acoustic tag 122A. The at least one sensor 204 may also include a pressure sensor that senses a pressure level of the wellbore 106 at the location proximate to first acoustic tag 122A. The at least one sensor may also include additional sensors operable to determine a vibration, displacement, velocity, torque, acceleration, and other properties of the wellbore at the location proximate to the first acoustic tag 122A. In some embodiments, the at least one sensor 204 also includes sensors that are operable to detect presence of nearby hydrocarbon resources. In one of such embodiments, the at least one sensor 204 also includes sensors that are operable to determine a distance from the nearby hydrocarbon resources to the first acoustic tag 122A. In further embodiments, the at least one sensor 204 may further determine the concentration of the nearby hydrocarbon resources. In further embodiments, the at least one sensor 204 may further determine the extraction rate of the nearby hydrocarbon resources. The at least one sensor 204 may further include additional sensors that are operable to determine additional nearby wellbore and/or hydrocarbon resource properties described herein.

In some embodiments, the first acoustic tag 122A also includes a storage medium 206. The storage medium 206 may be formed from data storage components such as, but not limited to, read-only memory (ROM), random access memory (RAM), flash memory, magnetic hard drives, solid state hard drives, as well as other types of data storage components and devices. In some embodiments, the storage medium 206 includes multiple data storage devices. The storage medium 206 includes instructions for operating one or more components of the first acoustic tag 122A. The storage medium 206 also includes an identification of the first acoustic tag 122A.

The storage medium 206 includes instructions for operating one or more components of the first acoustic tag 122A. The storage medium 206 also includes an identification of the first acoustic tag 204. The storage medium 206 also includes data indicative of nearby wellbore and/or hydrocarbon resource properties obtained by the at least one sensor 204 of the first acoustic tag 122A. In some embodiments, the storage medium 206 also includes data indicative of wellbore and/or hydrocarbon resource properties obtained by a sensor of another acoustic tag. In other embodiments, the storage medium 206 also includes data indicative of the locations of other acoustic tags as well as the operational status of the other acoustic tags.

The first acoustic tag 122A also includes a processor 208 that is operable to execute the instructions stored in the storage medium 206 to determine nearby wellbore and/or hydrocarbon resource properties, to establish communication channels with other acoustic tags, the sensor boxes 150 and 152, and/or the controller 184, and to perform other operations described herein. In some embodiments, the processor 208 is a sub-component of the sensor 204 or the transmitter 202. In further embodiments, the processor 208 is a separate component that utilizes the sensor 204, the transmitter 202, and the other components of the first acoustic tag 122A to perform the operations described herein. The first acoustic tag 122A further includes a power source 210 that provides power to the first acoustic tag 122A. In some embodiments, the power source 122A is a rechargeable power source. In one of such embodiments, the power source 210 is operable to convert kinetic energy, such as vibrations generated during hydrocarbon production or generated from a downhole tool deployed in the casing 116, to electrical energy to recharge the power source 210. As such, the power source 210 may be recharged at the downhole location where the first acoustic tag 122A is deployed. In other embodiments, the power source 122A may also be recharged from energy generated due to chemical reactions between fluids proximate the power source 122A.

Figure 3:
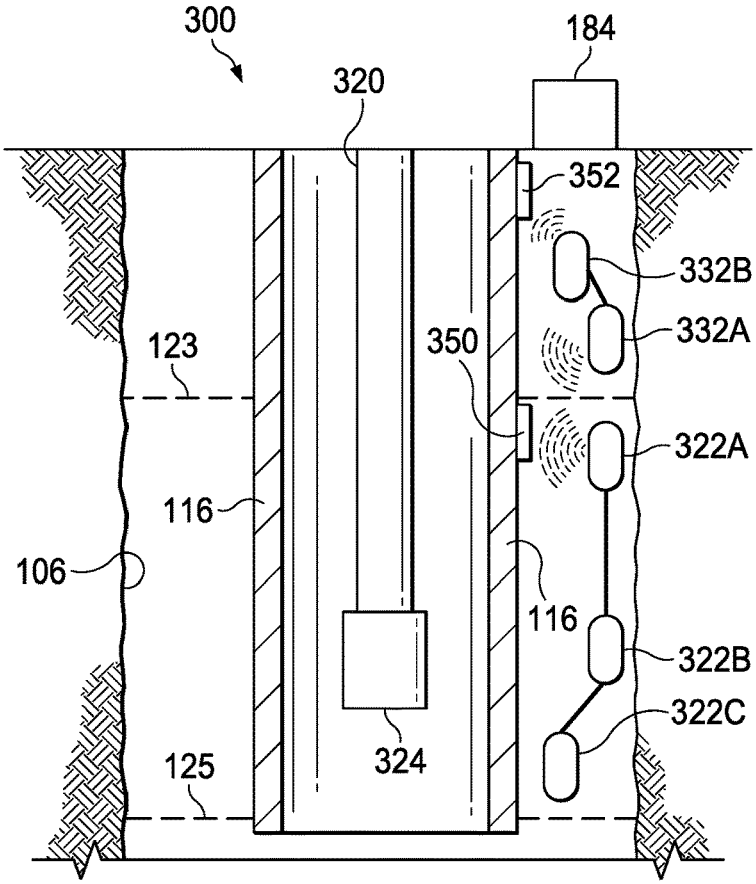
FIG. 3 illustrates a schematic view of a downhole acoustic communication network having acoustic tags and sensor boxes operable to detect acoustic signals transmitted from one or more of the acoustic tags.

FIG. 3 illustrates a schematic view of a downhole acoustic communication network 300 having acoustic tags 322A-C, 332A, and 332B, sensor boxes 350 and 352 operable to detect acoustic signals transmitted from one or more of the acoustic tags of the acoustic communication network 300. The acoustic tags include a first plurality of acoustic tags 322A-322C, which are mixed with cement deposited in a first section of the wellbore 106. The acoustic tags also include a second plurality of acoustic tags 332A and 332B, which are mixed with mud and deposited in a second section of the wellbore 106. Each acoustic tag of the first plurality of acoustic tags 322A-322C is operable to transmit acoustic signals within a first frequency range. Further, each acoustic tag of the second plurality of acoustic tags 332A and 332B is operable to transmit acoustic signals within a second frequency range.

The sensor boxes 350 and 352 include a first sensor box 350 and a second sensor box 352, and are deployed along a side of the casing 116. Each of the sensor boxes 350 and 352 includes acoustic detectors that are operable to detect acoustic signals within the first and second frequency ranges. Each of the sensor boxes 350 and 352 also includes a storage medium operable to store data indicative of the acoustic signals transmitted from one or more of the first and second plurality of acoustic tags 322A-322C, 332A, and 332B. In some embodiments, the sensor boxes 350 and 352 are communicatively connected to each other via one or more communication techniques such as, but not limited to acoustic communication, electrical communication, optical communication, or another form of communication described herein. Further, the sensor boxes 350 and 352 are operable to transmit data indicative of the acoustic signals from the first sensor box 350 to the second sensor box 352. In one of such embodiments, the second sensor box 352 is also communicatively connected to the controller 184. In such an embodiment, data stored on the storage medium of the first sensor box 350 may be transmitted to the second sensor box 352, and retransmitted from the second sensor box 352 to the controller 184.

A downhole detector 324 coupled to a conveyance 320 is deployed in the casing 116. The downhole detector 324 includes a storage medium and is operable to receive acoustic, electrical, or optical data emitted by the first and second sensor boxes 350 and 352, which corresponds to the information stored in sensor boxes 350 and 352, when the downhole detector 324 is deployed at a location proximate to the first and second sensor boxes 350 and 352, respectively. In some embodiments, the downhole detector 324 is also operable to receive acoustic signals transmitted by the first and the second plurality of acoustic tags 322A-322C, 332A, and 332B.

In some embodiments, each of the acoustic tags 322A-322C, 332A, and 332B is operable to establish one or more acoustic communication channels to communicatively connect said acoustic tag to another nearby acoustic tag. In one of such embodiments, the third acoustic tag of the first plurality of acoustic tags (third acoustic tag 322C) is deployed at a location where acoustic signals transmitted by said acoustic tag are not be strong enough to be detected by the first sensor box 352 or the downhole tool 324. However, the third acoustic tag 332C is deployed proximate a second acoustic tag of the first plurality of acoustic tags (second acoustic tag 322B). The second and third acoustic tags 322B and 322C communicate with each other to establish a first acoustic communication channel. The third acoustic tag 322C then transmits acoustic signals to the second acoustic tag 322B together with a request for the second acoustic tag 322B to transmit the acoustic signals to a nearby sensor box 350 or to the downhole tool 324. As stated herein, the acoustic signals may include an indication of an identification of the third acoustic tag 322C, a location of the third acoustic tag 322C, a distance from the first acoustic tag 322C to the second boundary 125 of the cement mixture 121, nearby wellbore properties, and/or nearby hydrocarbon properties.

The second acoustic tag 322B is also deployed too far from the nearest sensor box 350 or the downhole tool 324 for the nearest sensor box 350 or the downhole tool 324 to detect acoustic signals transmitted from the second acoustic tag 322B. However, the second acoustic tag 322B is deployed proximate a first acoustic tag of the first plurality of acoustic tags (second acoustic tag 322A). The second and first acoustic tags 322B and 322A communicate with each other to establish a second acoustic communication channel to communicatively connect the two acoustic tags 322A and 322B. Additional acoustic communication channels (not shown) may be established to communicatively connect additional acoustic tags to the first, second, and/or third acoustic tags 322A, 322B, and/or 322C, thereby communicatively connecting the acoustic tags along a communication path. As defined herein, a communication path includes multiple communication channels. As such, the communication path communicatively connects multiple acoustic tags, such as the first second and third acoustic tags of the first plurality of acoustic tags 322A-322C. In the embodiment illustrated in FIG. 3, a first communication path is formed between the first, second, and third acoustic tags of the first plurality of acoustic tags 322A-322C. In another embodiment, a communication path may be formed from a different number of acoustic tags deployed in the wellbore 106.

The first acoustic tag is deployed at a location proximate to the first sensor box 350, and is operable to transmit acoustic signals that may be detected by the first sensor box 350. In some embodiments, the acoustic signals may include an indication of an identification of the first acoustic tag 322A, a location of the first acoustic tag 322A, a distance from the first acoustic tag 322A to the first boundary 123 of the cement mixture 121, nearby wellbore properties, and/or nearby hydrocarbon properties. The acoustic signals may also include acoustic signals transmitted from the second and third acoustic tags 322B and 322C. As such, the first acoustic tag 322A is operable to re-transmit acoustic signals transmitted from any other acoustic tag that is communicatively connected to the first acoustic tag 322A along the first communication path.

The second plurality of acoustic tags also includes a first acoustic tag 332A and a second acoustic tag 332B. The first acoustic tag 332A, similar to the third acoustic tag 322C, is deployed at a location where acoustic signals transmitted by said acoustic tag may not be strong enough to be detected by the nearest sensor box (e.g., second sensor box 352). However, the first acoustic tag 332A is deployed nearby the second acoustic tag 332B, and the second sensor box 352 is positioned within proximity of the second acoustic tag 332B to detect signals transmitted by the second acoustic tag 332B. As such, the first and second acoustic tags 332A and 332B establish a third communication channel to communicatively connect to each other. Once the third communication channel is established, the first acoustic tag 332A transmits acoustic signals to the second acoustic tag 332B. The second acoustic tag 332B, upon receipt of the acoustic signals from the first acoustic tag 332A, transmits the received acoustic signals to the second sensor box 352. In some embodiments, where the second acoustic tag 323B is deployed proximate the controller 184, the second acoustic tag is also operable to transmit the acoustic signals received from the first acoustic tag 332A directly to the controller 184.

Figure 4:
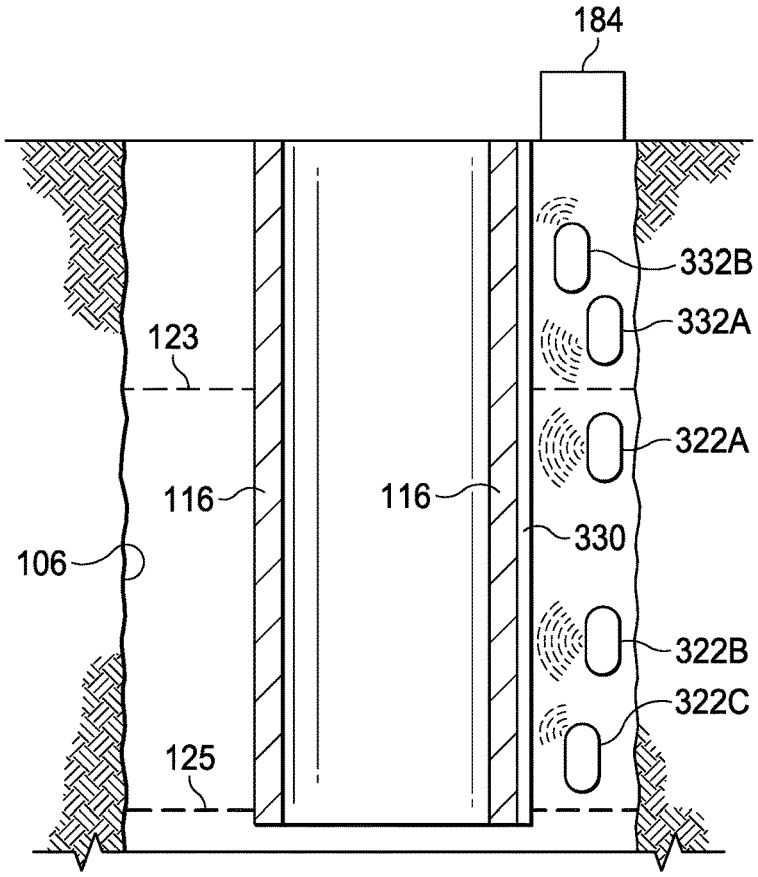
FIG. 4 illustrates a schematic view of another downhole acoustic communication network having an optical fiber deployed along a casing and operable to perform distributed acoustic sensing of acoustic signals transmitted from the one or more acoustic tags of FIG. 3.

FIG. 4 illustrates a schematic view of another downhole acoustic communication network 400 having an optical fiber 330 deployed along the casing 116 and operable to perform one or more types of distributed sensing, such as distributed acoustic sensing and distributed strain sensing of acoustic signals transmitted from the one or more acoustic tags 322A-C, 332A, and 332B of FIG. 3. More particularly, as a non-limiting example, optical pulses generated from an optoelectronic device (not shown), such as a pulse laser, travel through the optical fiber 330 from a location proximate to the optoelectronic device downhole. The optical pulses are backscattered and the backscattered optical pulses traverse the optical fiber 330 up hole towards the controller 184, where the backscattered optical pulses are analyzed. The acoustic signals transmitted from the one or more acoustic tags interact with the optical fiber 330, which in turn modifies the backscattered optical pulses. The controller 184 analyzes the modified backscattered optical pulses to perform one or more types of distributed sensing of the acoustic signals. In one embodiment, the controller 184 is operable to dynamically analyze the modified backscattered optical pulses. In some embodiments, acoustic signals transmitted from one or more of the acoustic tags are stored in one or more sensor boxes (not shown), such as the sensor boxes shown in FIGS. 1A and 3, and are retransmitted from the sensor boxes to the optical fiber 330.

In some embodiments, where one or more acoustic tags are deployed at locations where distributed acoustic sensing of acoustic signals transmitted from said acoustic tags may not be accurately performed, the said acoustic tags may establish acoustic communication channels and communication paths with an acoustic tag that is deployed within proximity of the optical fiber 330. The said one or more acoustic tags may then transmit acoustic signals via the acoustic communication channels or paths to the acoustic tag that is deployed within proximity of the optical fiber 330, where acoustic tag that is proximate to the optical fiber 330 then re-transmits the acoustic signals to the optic fiber 330.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a method to determine a boundary of a cement mixture deposited in a wellbore, the method comprising detecting first acoustic signals transmitted from at least one of a first plurality of acoustic tags mixed with a cement slurry deposited along a first section of a wellbore in an annulus between a casing and the first section of the wellbore; and determining a location of a first boundary of the cement slurry based on the first acoustic signals.

Clause 2, the method of clause, further comprising detecting second acoustic signals transmitted from at least one of a second plurality of acoustic tags mixed with mud deposited in a second section of the wellbore, wherein the cement slurry is separated from the mud along the first boundary of the cement slurry, and wherein determining the location of the first boundary of the cement slurry is based on the second acoustic signals.

Clause 3, the method of clause 1 or 2, further comprising detecting third acoustic signals transmitted from at least one of a third plurality of acoustic tags mixed with a displacement fluid deposited in a third section of the wellbore, the displacement fluid being separated from the cement slurry along a second boundary of the cement slurry; and determining a location of the second boundary of the cement slurry based on at least one of the first acoustic signals and the third acoustic signals.

Clause 4, the method of any of clauses 1-3, wherein the first acoustic signals are transmitted within a first frequency range, wherein the second acoustic signals are transmitted within a second frequency range, and wherein determining the location of the first boundary of the cement slurry comprises determining a first location along the casing where acoustic signals within the first frequency range and acoustic signals within the second frequency ranges are detected.

Clause 5, the method of any of clauses 1-4, further comprising determining a location along the casing where a signal intensity of the first acoustic signals and a signal intensity of the second acoustic signals are approximately equal, wherein, the first location along the casing is the location along the casing where the signal intensity of the first acoustic signals and the signal intensity of the second acoustic signals are approximately equal.

Clause 6, the method of any of clauses 1-5, wherein detecting the first acoustic signals and the second acoustic signals comprise performing distributed sensing of the first acoustic signals and the second acoustic signals along an optical fiber deployed along the casing.

Clause 7, the method of any of clauses 1-6, further comprising: determining a volume of the cement slurry; calculating an estimated location of the first boundary of the cement slurry based on the volume of the cement slurry; and determining whether the cement slurry leaked into a formation surrounding the first section of the wellbore based on a disparity between the determined location of the first boundary of the cement slurry and the estimated location of the first boundary of the cement slurry.

Clause 8, the method of any of clauses 1-7, wherein the first acoustic signals comprise indications of identifications of the at least one of the first plurality of acoustic tags, and wherein determining the location of the first boundary of the cement slurry comprises determining the identifications of the at least one of the first plurality of acoustic tags.

Clause 9, the method of any of clauses 1-8, further comprising determining a signal intensity of the first acoustic signals; and determining a presence of a leak into a formation surrounding the first section of the wellbore based on the signal intensity of the first acoustic signals.

Clause 10, the method of any of clauses 1-9, further comprising storing the first acoustic signals in a downhole storage medium; and providing the first acoustic signals to a controller operable to determine the location of the first boundary of the cement slurry, wherein determining the location of the first boundary of the cement slurry is performed by the controller.

Clause 11, the method of clause 1, wherein detecting the first acoustic signals comprises detecting a first set of acoustic signals at time $\tau_1$ and $\tau_2$, a difference between $\tau_2$ and $\tau_1$ indicative of a timing delay, and wherein determining the location of the first boundary comprises determining, based on the timing delay, the location of the first boundary.

Clause 12, a method to determine a boundary of a cement mixture deposited in a wellbore, the method comprising receiving first acoustic signals transmitted from at least one of a first plurality of acoustic tags mixed with cement deposited along a first section of a wellbore in an annulus between a casing and the first section of the wellbore; receiving second acoustic signals transmitted from at least one of a second plurality of acoustic tags mixed with a first substance deposited in a second section of the wellbore, the first substance and the cement having different material properties, and the first substance being separated from the cement along a first boundary of the cement; and determining a location of the first boundary of the cement based on at least one of the first acoustic signals and the second acoustic signals.

Clause 13, the method of clause 12, wherein the first acoustic signals comprise indications of identifications of the at least one of the first plurality of acoustic tags, and wherein determining the location of the first boundary of the cement comprises determining the identifications of the at least one of the first plurality of acoustic tags.

Clause 14, the method of clause 12 or 13, further comprising determining a signal intensity of the first acoustic signals; and determining a presence of a leak into a formation surrounding the first section of the wellbore based on the signal intensity of the first acoustic signals.

Clause 15, the method of any of clauses 12-14, further comprising receiving third acoustic signals transmitted from at least one of a third plurality of acoustic tags mixed with a second substance and deposited in a third section of the wellbore, the second substance and the cement having different material properties, and the second substance being separated from the cement along a second boundary of the cement; and determining a location of the second boundary based on the third acoustic signals.

Clause 16, a downhole acoustic communication network, comprising a first plurality of acoustic tags mixed with cement deposited along a first section of a wellbore in an annulus between a casing and the first section of the wellbore, each acoustic tag of the first plurality of acoustic tags being operable to transmit acoustic signals within a first frequency range; a second plurality of acoustic tags mixed with mud deposited in a second section of the wellbore, each acoustic tag of the second plurality of acoustic tags being operable to transmit acoustic signals within a second frequency range; and at least one acoustic detector deployed along the casing, each detector of the at least one detector operable to: detect acoustic signals from at least one of the first plurality of acoustic tags and the second plurality of acoustic tags; and store the acoustic signals in a storage medium component of the respective detector.

Clause 17, the downhole acoustic communication network of clause 16, further comprising an optical fiber operable to perform distributed sensing of acoustic signals transmitted from at least one of the first plurality of acoustic tags.

Clause 18, the downhole acoustic communication network of clause 16 or 17, further comprising a controller operable to determine a first boundary of the cement based on acoustic signals transmitted from at least one of the first plurality of acoustic tags and the second plurality of acoustic tags.

Clause 19, the downhole acoustic communication network of any of clauses 16-18, wherein one or more of the at least one acoustic detector is operable to form an up-hole telemetry network operable to transmit the detected acoustic signals to a surface based controller.

Clause 20, the downhole acoustic communication network of any of clauses 16-19, wherein one or more of the first plurality of the acoustics tags are operable to form a first acoustic communication channel to transmit acoustic signals along the first acoustic communication channel to one or more of the at least one detector.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an" and "the" are intended to include the plural forms as well, unless the context clearly indicates otherwise. Unless otherwise indicated, as used throughout this document, "or" does not require mutual exclusivity. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A computer-implemented method to determine a boundary of a cement mixture deposited in a wellbore, the method comprising:

detecting first acoustic signals transmitted from at least one of a first plurality of acoustic tags mixed with a cement slurry deposited along a first section of a wellbore in an annulus between a casing and the first section of the wellbore, wherein the first acoustic signals are transmitted within a first frequency range;

detecting second acoustic signals transmitted from at least one of a second plurality of acoustic tags mixed with mud deposited in a second section of the wellbore, wherein the second acoustic signals are transmitted within a second frequency range;

determining a location where acoustic signals having two different frequency ranges are detected; and determining a location of a first boundary of the cement slurry based on the location where acoustic signals having two different frequency ranges are detected, wherein the cement slurry is separated from the mud along the first boundary of the cement slurry.

2. The computer-implemented method of claim 1, wherein detecting the first acoustic signals comprises detecting a first set of acoustic signals at time $\tau 1$ and $\tau 2$, a difference between $\tau 2$ and $\tau 1$ indicative of a timing delay, and wherein determining the location of the first boundary comprises determining, based on the timing delay, the location of the first boundary.

3. The computer-implemented method of claim 1, further comprising:

detecting third acoustic signals transmitted from at least one of a third plurality of acoustic tags mixed with a displacement fluid deposited in a third section of the wellbore, the displacement fluid being separated from the cement slurry along a second boundary of the cement slurry; and determining a location of the second boundary of the cement slurry based on at least one of the first acoustic signals and the third acoustic signals.

4. The computer-implemented method of claim 1, further comprising:

storing the first acoustic signals in a downhole storage medium; and providing the first acoustic signals to a controller operable to determine the location of the first boundary of the cement slurry, wherein determining the location of the first boundary of the cement slurry is performed by the controller.

5. The computer-implemented method of claim 1, further comprising:

determining a location along the casing where a signal intensity of the first acoustic signals and a signal intensity of the second acoustic signals are approximately equal, wherein, the first location along the casing is the location along the casing where the signal intensity of the first acoustic signals and the signal intensity of the second acoustic signals are approximately equal.

6. The computer-implemented method of claim 1, wherein detecting the first acoustic signals and the second acoustic signals comprise performing distributed sensing of the first acoustic signals and the second acoustic signals along an optical fiber deployed along the casing.

7. The computer-implemented method of claim 1, further comprising:

determining a volume of the cement slurry;

calculating an estimated location of the first boundary of the cement slurry based on the volume of the cement slurry; and determining whether the cement slurry leaked into a formation surrounding the first section of the wellbore based on a disparity between the determined location of the first boundary of the cement slurry and the estimated location of the first boundary of the cement slurry.

8. The computer-implemented method of claim 1, wherein the first acoustic signals comprise indications of identifications of the at least one of the first plurality of acoustic tags, and wherein determining the location of the first boundary of the cement slurry comprises determining the identifications of the at least one of the first plurality of acoustic tags.

9. The computer-implemented method of claim 1, further comprising:

determining a signal intensity of the first acoustic signals; and determining a presence of a leak into a formation surrounding the first section of the wellbore based on the signal intensity of the first acoustic signals.

10. A computer-implemented method to determine a boundary of a cement mixture deposited in a wellbore, the method comprising:

receiving first acoustic signals transmitted from at least one of a first plurality of acoustic tags mixed with cement deposited along a first section of a wellbore in an annulus between a casing and the first section of the wellbore, wherein the first acoustic signals are transmitted within a first frequency range;

receiving second acoustic signals transmitted from at least one of a second plurality of acoustic tags mixed with a first substance deposited in a second section of the wellbore, the first substance and the cement having different material properties, and the first substance being separated from the cement along a first boundary of the cement, wherein the second acoustic signals are transmitted within a second frequency range;

determining a location where acoustic signals having two different frequency ranges are detected; and determining a location of the first boundary of the cement based on the location where acoustic signals having two different frequency ranges are detected.

11. The computer-implemented method of claim 10, further comprising:

receiving third acoustic signals transmitted from at least one of a third plurality of acoustic tags mixed with a second substance and deposited in a third section of the wellbore, the second substance and the cement having different material properties, and the second substance being separated from the cement along a second boundary of the cement; and determining a location of the second boundary based on the third acoustic signals.

12. The computer-implemented method of claim 10, further comprising:

determining a signal intensity of the first acoustic signals; and determining a presence of a leak into a formation surrounding the first section of the wellbore based on the signal intensity of the first acoustic signals.

13. The computer-implemented method of claim 10, wherein the first acoustic signals comprise indications of identifications of the at least one of the first plurality of acoustic tags, and wherein determining the location of the first boundary of the cement comprises determining the identifications of the at least one of the first plurality of acoustic tags.

14. A downhole acoustic communication network, comprising:

a first plurality of acoustic tags mixed with cement deposited along a first section of a wellbore in an annulus between a casing and the first section of the wellbore, each acoustic tag of the first plurality of acoustic tags being operable to transmit acoustic signals within a first frequency range;

a second plurality of acoustic tags mixed with mud deposited in a second section of the wellbore, each acoustic tag of the second plurality of acoustic tags being operable to transmit acoustic signals within a second frequency range;

at least one acoustic detector deployed along the casing, each detector of the at least one detector operable to:

detect acoustic signals from at least one of the first plurality of acoustic tags mixed with a cement slurry and the second plurality of acoustic tags, wherein the first acoustic signals are transmitted within a first frequency range, and wherein the second acoustic signals are transmitted within a second frequency range; and store the acoustic signals in a storage medium component of the respective detector; and a controller operable to:

determine a location where acoustic signals having two different frequency ranges are detected; and determine a location of a first boundary of the cement slurry based on the location where acoustic signals having two different frequency ranges are detected.

15. The downhole acoustic communication network of claim 14, wherein one or more of the first plurality of the acoustics tags are operable to form a first acoustic communication channel to transmit acoustic signals along the first acoustic communication channel to one or more of the at least one detector.

16. The downhole acoustic communication network of claim 14, wherein one or more of the at least one acoustic detector is operable to form an up-hole telemetry network operable to transmit the detected acoustic signals to a surface based controller.

17. The downhole acoustic communication network of claim 14, further comprising an optical fiber operable to perform distributed sensing of acoustic signals transmitted from at least one of the first plurality of acoustic tags and the second plurality of acoustic tags.

* * * * *